US006109402A

United States Patent [19]

Godshaw et al.

[11] Patent Number: 6,109,402

[45] Date of Patent: Aug. 29, 2000

[54] SOFT SIDED LUGGAGE WITH SEPARABLE POUCHES

[75] Inventors: Donald E. Godshaw, Evanston; Andrezj Redzisz, Skokie, both of Ill.

[73] Assignee: Travel Caddy, Inc., Des Plaines, Ill.

[21] Appl. No.: 09/198,959

[22] Filed: Nov. 24, 1998

Related U.S. Application Data

[63] Continuation-in-part of application No. 08/987,295, Dec. 9, 1997, abandoned.

[51] Int. Cl.[7] ..... A45C 3/00; A45C 5/06; A45C 7/00; A45C 9/00

[52] U.S. Cl. ..... 190/108; 190/102; 190/107; 190/111; 150/113; 383/4

[58] Field of Search ..... 190/102, 108; 224/42.11; 150/111, 107, 1; 383/4

[56] References Cited

U.S. PATENT DOCUMENTS

| | | | |
|---|---|---|---|
| D. 227,818 | 7/1973 | Dipadpva | 190/108 X |
| D. 344,184 | 2/1994 | Barker | 224/42.11 X |
| 2,813,602 | 11/1957 | MacArthur, Jr. | 190/108 X |
| 3,729,038 | 4/1973 | Ekeson | 190/110 |
| 3,830,348 | 8/1974 | Ohyama | 190/108 X |
| 3,837,447 | 9/1974 | Honan | 190/108 X |
| 4,436,189 | 3/1984 | Baum | 190/108 |
| 4,640,392 | 2/1987 | Decker, Jr. et al. | 190/108 X |
| 4,685,546 | 8/1987 | Sadow | 190/102 |
| 4,795,030 | 1/1989 | Boyce | 190/108 X |
| 5,509,515 | 4/1996 | Guo | 190/108 X |
| 5,520,462 | 5/1996 | Clark | 190/102 X |
| 5,566,797 | 10/1996 | Van Himbeeck | 190/108 X |
| 5,685,401 | 11/1997 | Macgillivray et al. | 190/108 |
| 5,788,032 | 8/1998 | Krulik | 190/108 |

FOREIGN PATENT DOCUMENTS

| | | | |
|---|---|---|---|
| 69365 | 1/1952 | Netherlands | 224/42.11 |

*Primary Examiner*—Sue A. Weaver
*Attorney, Agent, or Firm*—Banner & Witcoff, Ltd.

[57] ABSTRACT

Luggage includes first and second separate pouches connected by a web and is adapted to be positioned over the handle of separate carrier luggage whereby the luggage may be utilized in a saddle bag type configuration or in an assembled configuration as a garment or other type bag.

21 Claims, 8 Drawing Sheets

SOFT SIDED LUGGAGE WITH SEPARABLE POUCHES

CROSS REFERENCE TO RELATED APPLICATION

This is a continuation-in-part of application Ser. No. 08/987,295 filed Dec. 9, 1997 for "Luggage", now abandoned, and which is incorporated herewith by reference.

BACKGROUND OF THE INVENTION

This invention relates to luggage of the type used to carry garments and the like. More particularly, this invention relates to bag style, soft-sided luggage having a pair of separate and separable luggage compartments or pouches to facilitate tandem transport generally in the form of a saddle bag which is adapted for use with companion wheeled luggage of the type having a telescoping handle.

Luggage, such as a garment bag which may be carried by straps or handles when fully loaded, is quite cumbersome and often is difficult to carry. This is especially so when the luggage is of a bag style type having soft sides. U.S. Pat. No. 5,685,401 entitled "Luggage with Passageway for Receiving a Supporting Handle," discloses a construction wherein generally soft-sided luggage may be used in combination with wheeled luggage having a projecting or telescoping handle which enables the wheeled luggage to serve as a base for carrying the bag. U.S. Pat. No. 5,685,401 depicts an opening for the handle of the wheeled luggage between adjacent compartments of the soft-sided luggage. Other patents disclose a "saddle bag" type construction wherein soft-sided bags may be supported on a carrier of one sort or the other. Examples include U.S. Design Pat. No. 344,184 for a Bag, U.S. Pat. No. 2,813,602 for Twin Bags, and Dutch Patent No. 69365.

Such described constructions appear to be useful for their intended and specific purpose. Nonetheless, there has remained the need for an improved luggage or bag construction, particularly soft bags which can be used in combination with wheeled luggage yet which provides a convenient means and construction for carriage of the soft bag by itself.

SUMMARY OF THE INVENTION

In a principal aspect, the present invention comprises luggage which has a web connecting first and second separable pouches or compartments. The first pouch includes a closed loop, generally rectangular, with a handle or strap attached to the top side of the loop. The loop forms the top, bottom and connecting sides of a pouch enclosure. Lateral sides are attached to the loop to further define the pouch enclosure. One of the lateral sides is permanently affixed to the loop and the other lateral side may be detachably affixed for access to the interior of the pouch. A second pouch is attached to the first pouch by means of a web fastened to and extending from the intersection of the top side of the loop and the permanently attached lateral side of the first pouch. The second pouch may be defined, in part, by the web which extends from the first pouch and connects to the second pouch. The web includes at least one opening which is adapted to fit over the handle of carrier luggage. The web and second pouch also define a panel removably attached to the permanently attached lateral side panel forming the first pouch. In this manner the luggage may be configured in a first or saddle bag type configuration where the web fits over wheeled or carrier luggage and the pouches fit on opposite sides of the carrier luggage or in a second configuration wherein the pouches are fastened together into an integral whole soft-side luggage assembly.

Another embodiment of the invention provides first and second separate pouches connected by a web which extends along at least a portion of the top of the soft-sided luggage. The web may be folded and stored in the region between the pouches. Fasteners may releasibly connect the pouches tightly together, for example by means of a zipper or other fastening means. An array of openings in the web and stiffness in the web facilitate its use as a baggage handle or for support by a wheeled carrier with a handle.

Thus it is an object of the invention to provide improved luggage, particularly soft-sided luggage.

It is a further object of the invention to provide luggage having the capacity to be configured in a saddle bag configuration or as an integral single, soft-sided luggage configuration.

Yet a further object of the invention is to provide improved soft-sided luggage designed to carry folded clothing or other articles conveniently within the luggage and to permit easy access to the interior of the luggage.

Yet another object of the invention is to provide soft-sided luggage which may be used in combination with wheeled luggage of the type having a telescoping handle whereby the soft-sided luggage may be easily incorporated with and provided as part of a combination including the wheeled luggage.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENTS

Figure 1:
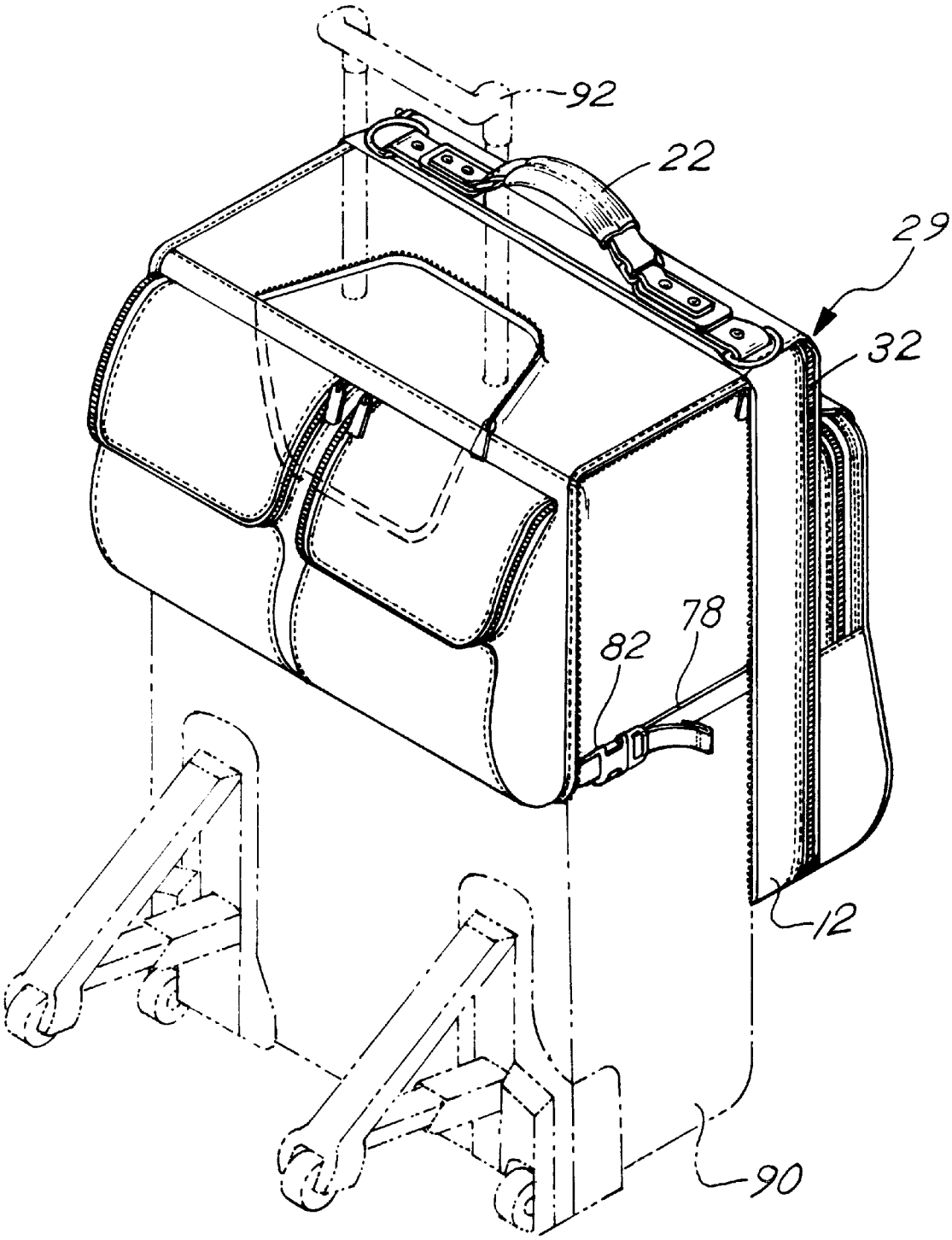
FIG. 1 is an isometric view of a first embodiment of the luggage of the invention in combination with wheeled luggage having a telescopic handle.

FIGS. 1 through 5 depict a first embodiment of the invention. FIGS. 6 through 10 depict a second embodiment. FIGS. 11 through 14 depict a third embodiment similar to the second embodiment. Reference will therefore be made, initially, to the embodiment of FIGS. 1 through 5.

The luggage of the invention, as depicted in FIGS. 1 through 5, is typically manufactured from a soft material or fabric such as a canvas or a woven plastic material or some other fabric or leather material which is generally soft or foldable. Such bags are typically called soft luggage or soft-sided luggage as contrasted with molded plastic, metal or heavy leather luggage which is rigid.

In any event, the first embodiment of the invention comprises a generally rectangular, parallelpipped loop 12 which includes opposite sides 14 and 16 as well as a connecting top 18 and a bottom 20. The loop 12 is thus generally rectangular and is sufficiently rigid to maintain its form or shape. For example, the loop 12 may be fabricated from a fabric material with wire or plastic stiffeners provided in that material in order to give the loop shape and form. However, the loop 12 does have a certain amount of "give" or resiliency. It is noted that the loop configuration is not limited to a rectangular shape. Other shapes may be utilized, both polygonal and curved, or mixtures thereof.

Figure 5:
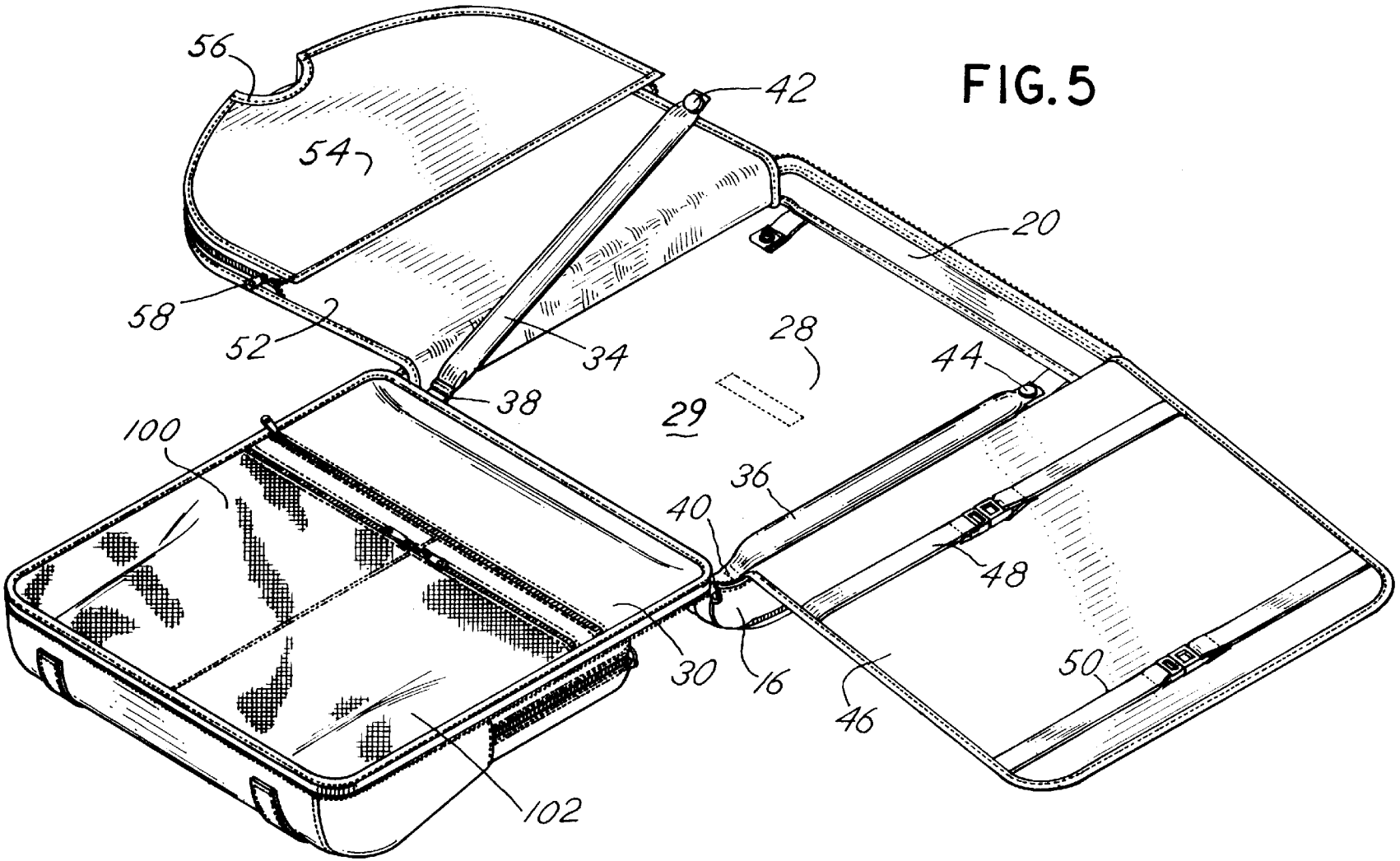
FIG. 5 is an isometric view of the luggage of FIG. 4 wherein the internal compartments of one of the pouches of the luggage is exposed.

The top side 18 includes a handle 22 affixed thereto. The handle 22 may include metal loops 24 and 26 to which a carrying strap (not shown) may be attached. The loop 12 defines the peripheral sides of a first pouch, or compartment, or enclosure 29. Further included as portions of the first pouch are a first lateral side 28 attached about its periphery to the periphery of the loop 12 to form a compartment or first enclosure and a second lateral side 30 which is removably attached to the loop 12, for example by means of a zipper 32. As shown in FIG. 5, the second lateral side 30 is generally rectangular and congruent with the first lateral side 28. The second lateral side 30 may be zipped to or attached to the loop 12 to form an enclosed first enclosure compartment or pouch 29.

Within the first compartment or pouch 29 are retaining bars 34 and 36 which are hingedly attached at hinges 38 and 40 respectively to the inside surface of the lateral side 28 and which may be snap fastened by fasteners 42 and 44 respectively to the panel or first lateral side 28. The bars 34 and 36 thus hold clothing or other material within the compartment or first pouch.

A first flap 46 is attached by means of a flexible hinge to a side 16 of the loop 12. Retaining straps 48 and 50 are affixed to the flap 46. A second flap 52 is attached or hinged by a flexible hinge to the side wall 14 of the loop 12. The second flap 52 includes a zipper attached cover 54 through which a hanger may be positioned in a cutout 56. Thus the zipper 58 facilitates detachment of the cover 54 or partial detachment thereof. The flaps 46 and 54, in combination with the compartment formed by the loop 12 and side 28, provide a combination of elements for attachment of hanging garments such as a suit, coat or the like. They also, because of their arrangement and construction, enable compact and efficient folding of such clothing items. Referring to FIG. 5, it should be noted that the second lateral wall or side 30 of the first pouch may include zippered pockets, for example pockets 100 and 102. Also, the arrangement of flaps and pockets may be altered or varied to accommodate various packing schemes.

A second pouch 60 is formed in combination with a web 62 that connects to the juncture or seam of top side 18 with the first lateral side 28. The web 62 includes a trapezoidal flap 64 with a zipper 66 affixing the flap 64 to the web 62. The second pouch 60 includes a panel 68 which constitutes a continuation of the web 62. The panel 68 and web 62 may be attached to the first pouch by means of a zipper fastener 70 which extends about the periphery of the first lateral side 28 of the first pouch.

The luggage further includes a first strap connector 72 and a second strap connector 74 attached to the outside of the first lateral side 28 to engage with straps 76 and 78 respectively. The straps 76 and 78 may also be utilized in combination with connectors 80 and 82 respectively, as depicted in FIG. 1, affixed to the panel 68. When the flap 64 is unzipped or opened as depicted in FIG. 1 and the web 62 is fitted over the top of wheeled luggage 90 with a handle 92 projecting through an opening defined by flap 64, the strap 78 and strap 82 may be joined to help retain the assembly on the wheeled luggage 90. Note the length of strap 78 is adjustable to accommodate various sizes of wheeled luggage 90.

Figure 2:
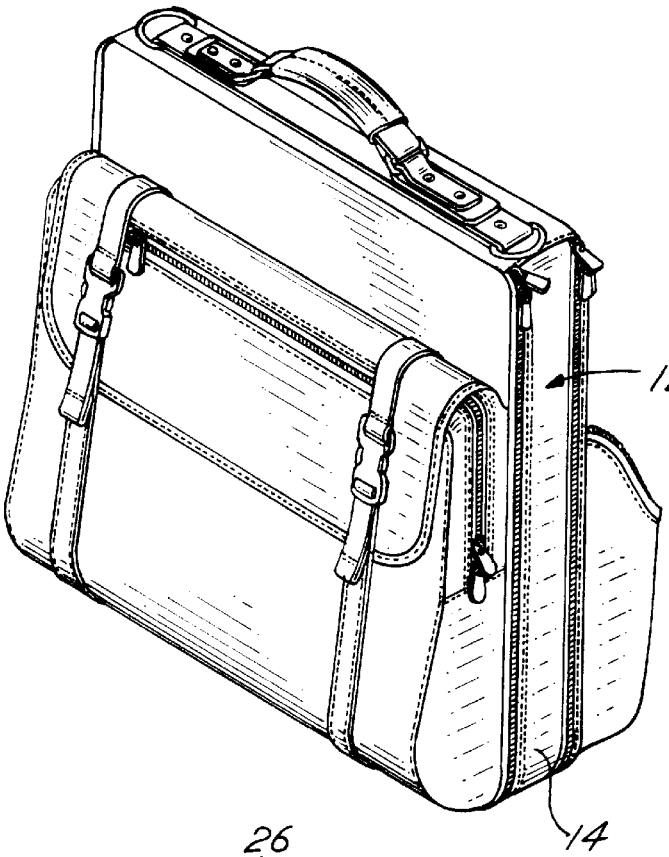
FIG. 2 is an isometric view of the luggage of FIG. 1 assembled in a single integral luggage form or combination.
Figure 3:
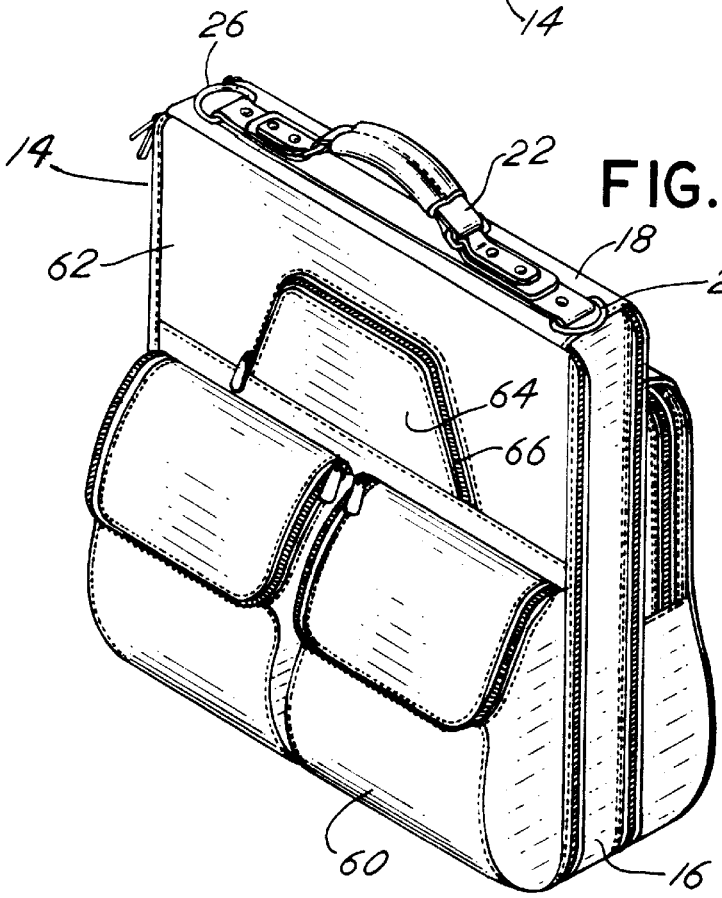
FIG. 3 is an isometric view of the luggage of FIG. 2 taken from the opposite side of that shown in FIG. 2.
Figure 4:
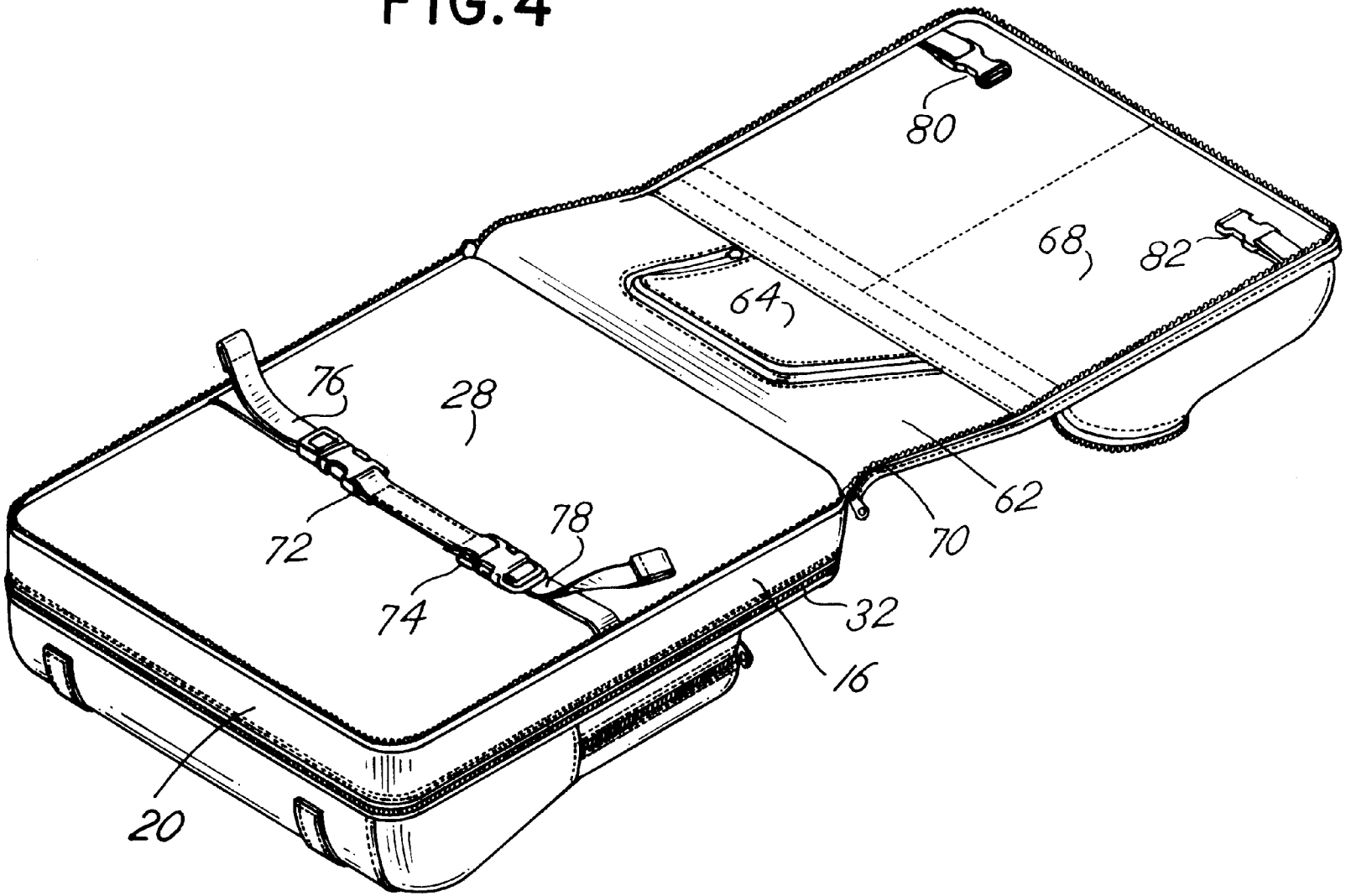
FIG. 4 is an isometric view of the luggage of FIG. 1 wherein the pouches forming the luggage are depicted in a detached or saddle bag configuration prior to placement on wheeled luggage for example.

The second pouch 60 may be of any preferred configuration. In the embodiment shown, the second pouch 60 is divided into a series of zippered pouches which are fixed to the outside of the panel 68. As shown in FIGS. 2 and 3, the luggage of the first embodiment may be fastened together to provide a garment carrier of traditional size and design. Alternative, the zipper 70 may be unzipped to thereby detach the panel 68 and web 62 to permit placement of the luggage on the wheeled carrier 90 as depicted in FIG. 1.

Figure 6:
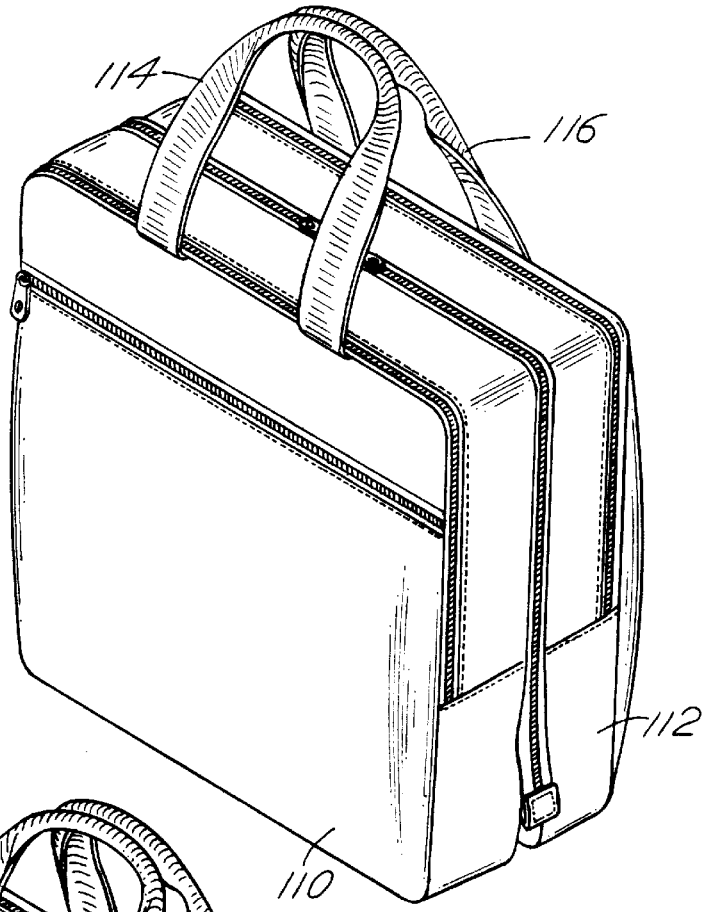
FIG. 6 is an isometric view of a second alternative embodiment of the invention depicting the luggage from a front side thereof.
Figure 7:
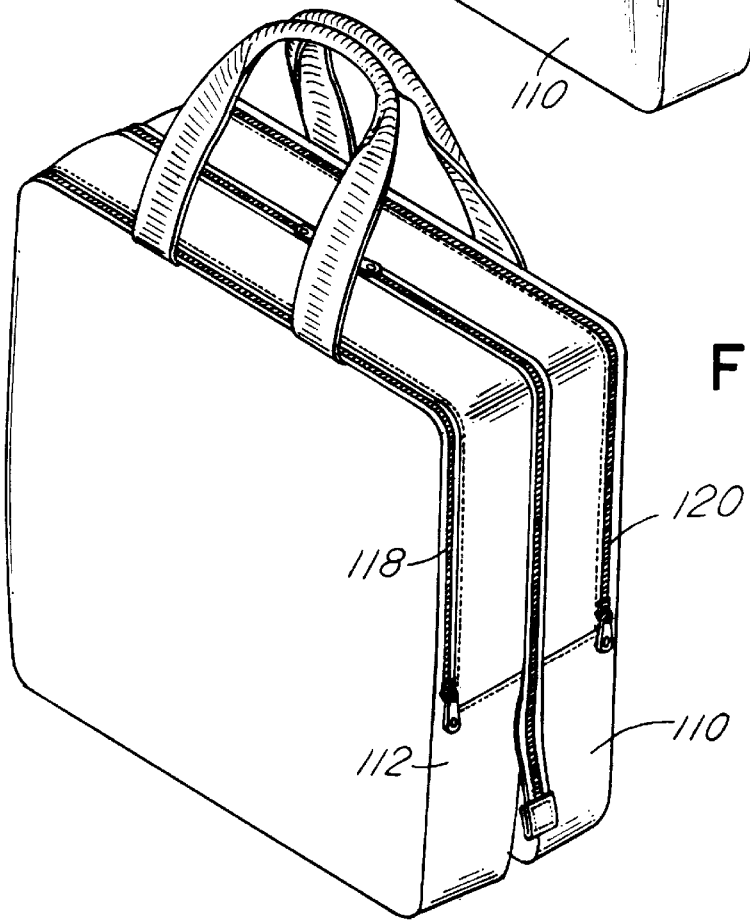
FIG. 7 is an isometric view of the embodiment shown in FIG. 6 from the backside thereof.
Figure 8:
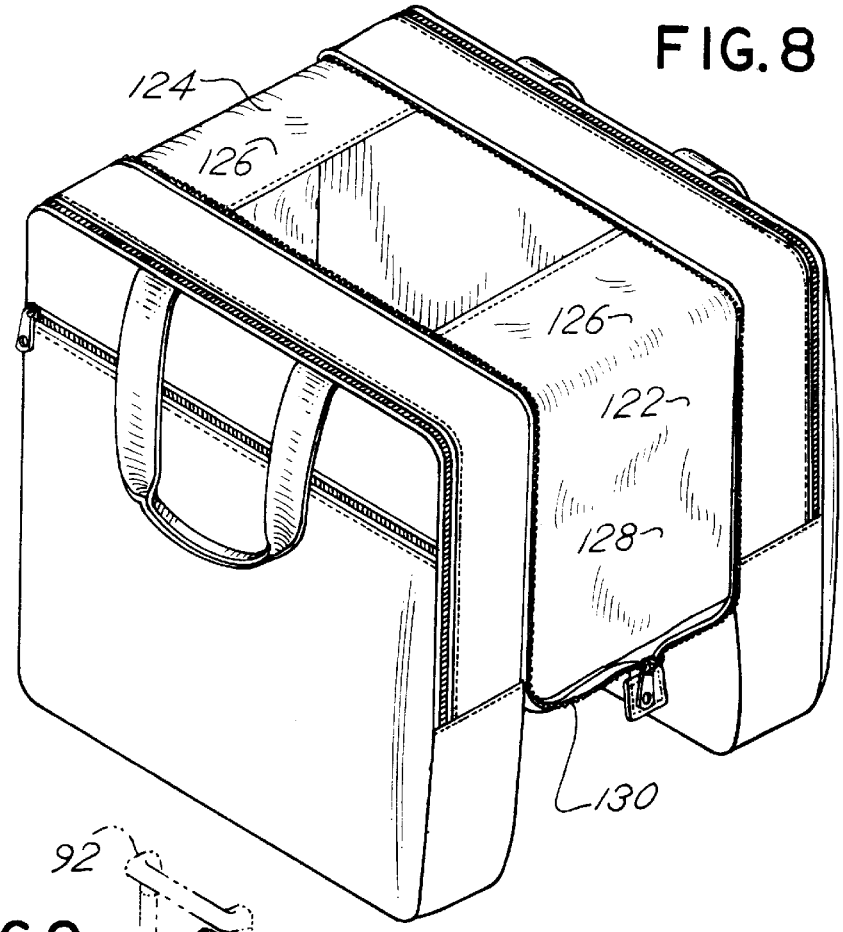
FIG. 8 is an isometric view of the luggage of FIG. 6 wherein the pouches forming the luggage have been detached from each other to expose the saddle bag or flexible connection between the separate pouches.
Figure 9:
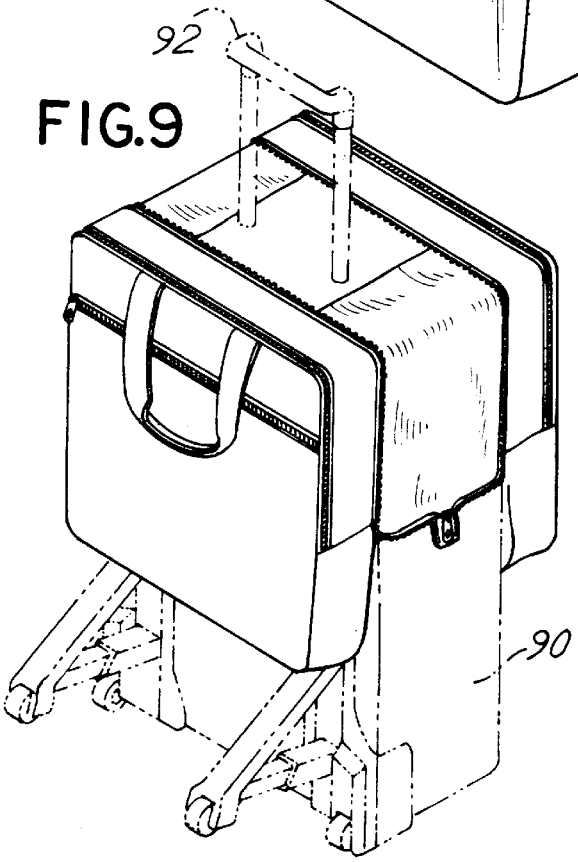
FIG. 9 is an isometric view of the luggage of FIG. 8 in combination with wheeled luggage of the type having a telescopic handle.

FIGS. 6 through 10 illustrate a second embodiment of the invention. Referring to these Figures, again the baggage is fabricated from a soft material and the separate compartments need not have any reinforced or rigid sides. Thus the product is soft-sided luggage. The luggage includes a first pouch 110 and a second separate pouch 112. The pouches 110 and 112 each include a handle 114 and 116 respectively attached thereto. In the embodiment shown, the pouches 110, 112 each have a generally rectangular, parallelpipped shape. Various zippers, such as zippers 118 and 120, are provided for access to the interior of the respective pouches 110 and 112. The pouches 110, 112 further include a web comprised of separate web sections 122 and 124 which connect the pouches 110, 112. Each web section 122 and 124 includes both an upper side or panel 126 and a lower panel 128. The web sections 122 and 124 are made from a fabric or foldable material and permit the separate pouches 110 and 112 to be placed over wheeled luggage 90 with the handle 92 projecting through the space between the panels 126. A zipper 130 serving as a fastener means may be utilized to release the web sections 122, 124 or compress the web 121 as depicted in FIGS. 6 and 8 for example.

Figure 10:
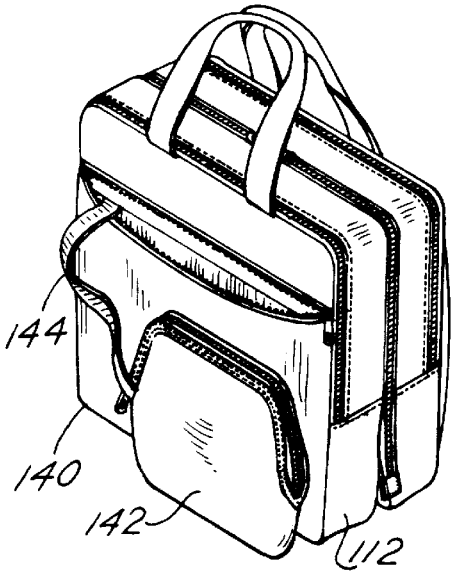
FIG. 10 is an isometric view of an alternative construction of a bag of the type depicted in FIG. 6 wherein an auxiliary bag is provided into which the bag of FIG. 6 may be folded and stored.
Figure 11:
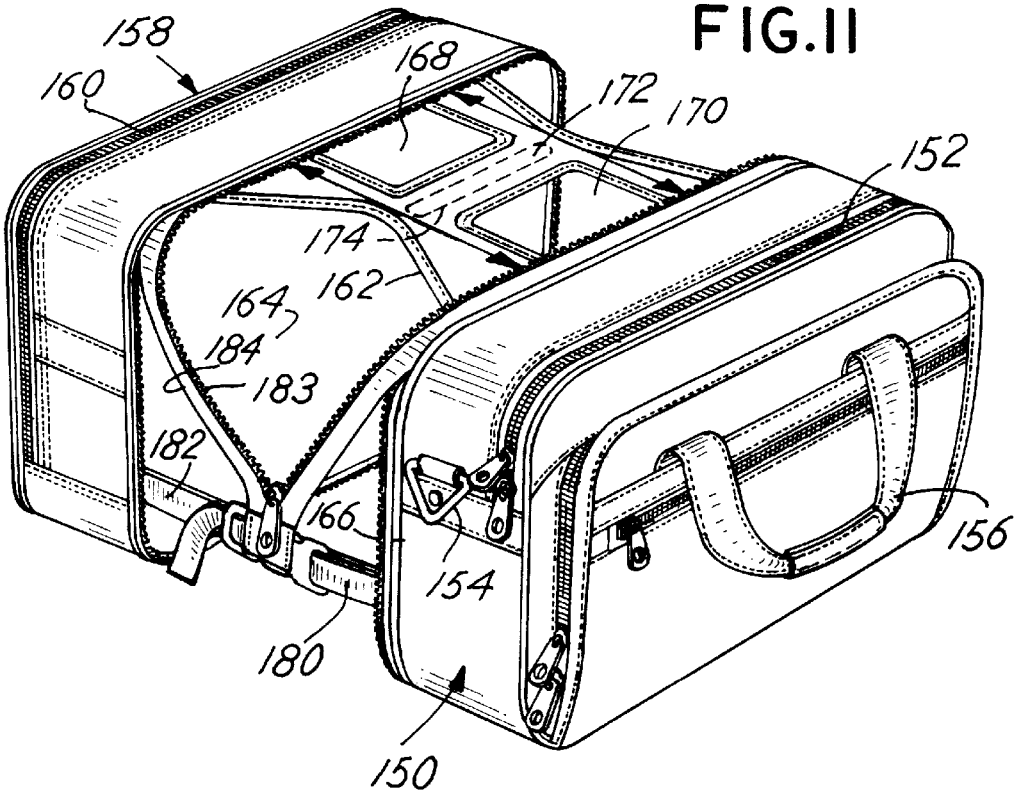
FIG. 11 is an isometric view of a third embodiment of the invention which includes a web that may serve as a handle as well as for connecting separable pouches.

The pouch 112 may also include, as depicted in FIG. 10, a side pouch 140 having an auxiliary bag 142 therein tethered by a strap 144. The entire soft-sided bag comprised of pouches 110 and 112 and web 121 may then be folded and placed in the storage bag 142.

FIGS. 11 through 14 illustrate a third embodiment of the invention along with some additional ancillary features that may be incorporated in any of the embodiments. Referring to those figures, a first pouch 150 includes a zipper 152 defining an opening for access to the interior of the pouch 150. Hooks, such as hook 154 are provided on the first pouch for attachment of a carrier strap. A handle 156 may be attached to the side or top of the pouch 150. A second pouch 158 also includes a zipper 160 for access to the interior of the pouch. The first pouch 150 and the second pouch 158 are connected together by a flexible web 162 which connects inside panels 164 and 166 of pouches 150 and 158. The panels 164 and 166 are generally congruent and opposed one to the other. The web 162 connects between the top edge of the panels 164 and 166. The web includes a first hand opening 168 and a second hand opening 170 with a center rib 172 intermediate the openings 168 and 170. A stiffener such as a plastic or bamboo stiffener rod 174 is provided in the rib 172 and generally arranged parallel to the panels 164, 166. Side connecting straps 180 and 182 are provided for retention of the pouches 150 and 158 a fixed space distanced defined by the web 162. A carrier handle of wheeled carrier luggage depicted in previous figures may be fitted through either openings 168 or 170 to support the pouches 150 and 158 thereon. A circumferential zipper 183 is provided about the periphery of the panels 164 and 166. The zipper 183 has a tail 184 which is sufficiently long so that the full extent of the web 162 may be realized in spacing the pouches 150 and 158 one from the other. In the preferred embodiment of FIGS. 11 through 14 the zipper 183 extends totally about the circumference of the panels 164 and 166, though total circumferential extent is not necessary.

Figure 12:
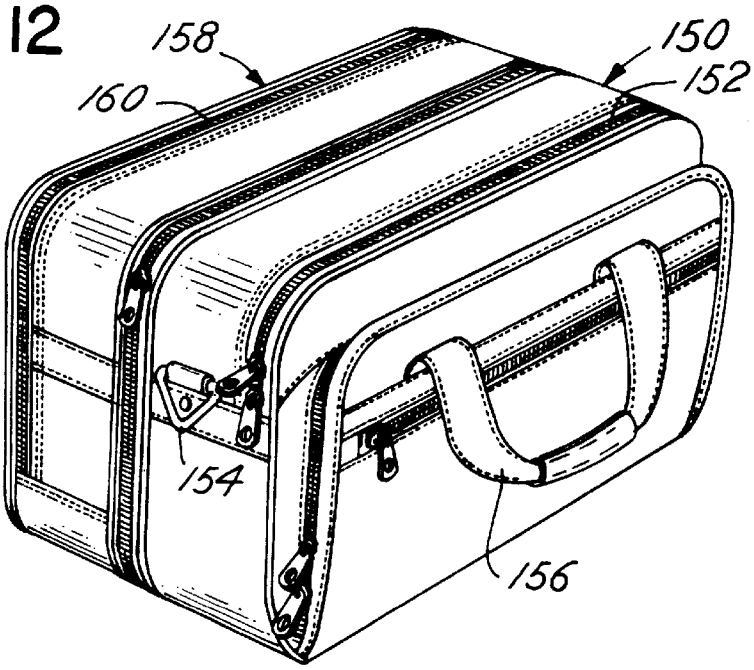
FIG. 12 is an isometric view of the embodiment of FIG. 11 in a closed bag condition.
Figure 13:
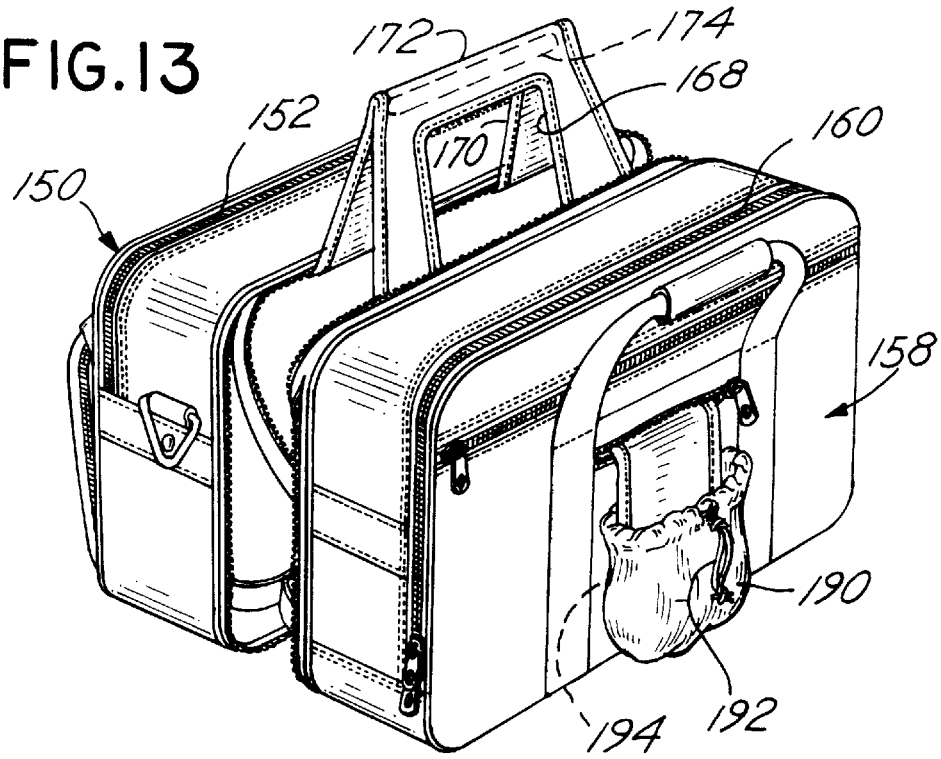
FIG. 13 is an isometric view of the bag of FIG. 11 arranged for manual carriage using the web.
Figure 14:
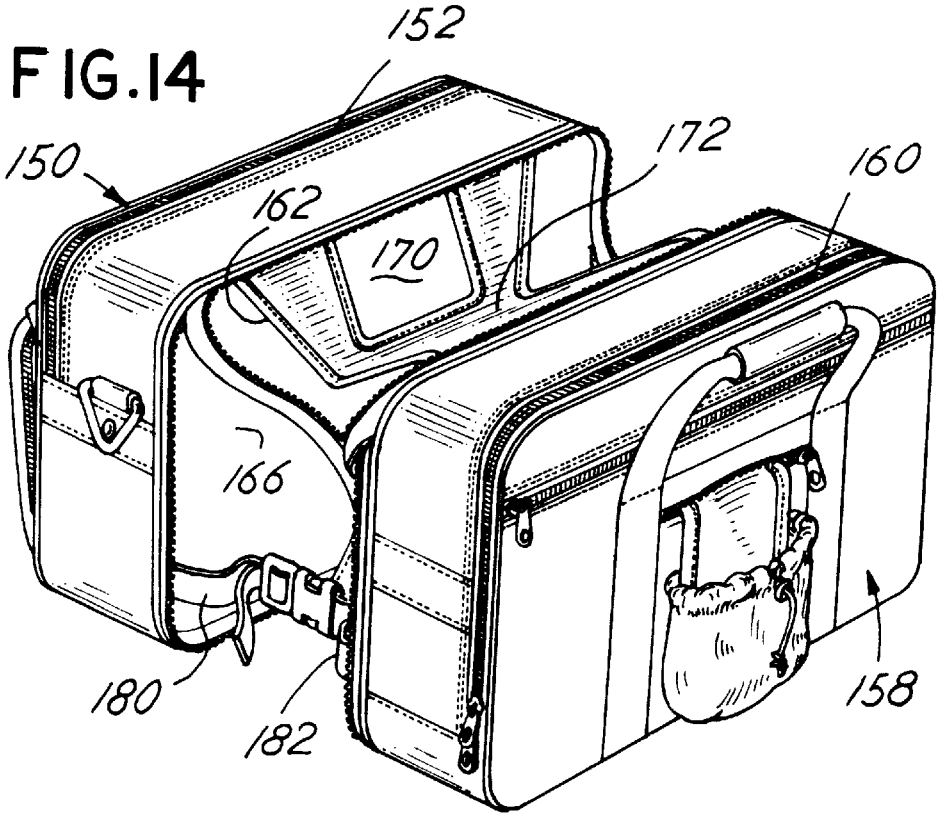
FIG. 14 is an isometric view of the bag of FIG. 13 arranged for folding into the form of FIG. 12.

FIGS. 13 and 14 illustrate the manner in which the web 162 may be folded in order to provide carriage of the pouches by the web, or alternatively, for folding of the pouches and fastening together as depicted in FIG. 12. Thus, as depicted in FIG. 13, the web 162 is projected upwardly with the openings 168 and 170 in opposed relation to define a manual passage as a hand hold. The stiffening bar 174 facilitates maintenance of the configuration of shape of the pouches 158 and 150 when held by the web. As depicted in FIG. 14, when the web 162 is folded downwardly between the panels 164 and 166 and the zipper 182 closed, then the panels 164 and 166 are arranged in face to face configuration and closed as depicted in FIG. 12.

An adjunct feature of any of the embodiments is depicted in FIG. 13. There a fold-out beverage bag 190 with a drawstring 192. When the pouch 190 is not in use, it may be folded back into a zippered compartment 194 defined in the side of the pouch 150.

In the foregoing, zippers have been described as the fastening means. Other fastening means may be utilized such as Velcro-type fasteners, buttons, hooks and other fasteners. The straps described may be elastic or inelastic adjustable or fixed in length. The arrangement and configuration of the pouches may also be varied. Rectangular parallelpipped construction has been described and it is believed to be the most economical and efficient. However, other configurations are possible and are to be considered within the scope of the invention or equivalent thereto. Thus the description of a rectangular parallelpipped, as well as a claim language directed to a rectangular parallelpipped construction, should be construed most broadly in a way to avoid not only the prior art but also to provide a fair and accurate range of equivalents. The placement and position of the handles and the shape of the flaps and openings for the telescoping handle on the carrier luggage may all be varied. Thus, the invention is to be limited only by the following claims and equivalents thereof.

What is claimed is:

1. Luggage having separable pouches connected by a web construction comprising, in combination:

a first pouch having a generally closed loop including a top side with a handle, said pouch further including a first lateral side attached about the periphery of the closed loop to form a first compartment, and a second lateral side at least in part removably attached to the periphery of the closed loop to enclose the first compartment;

a web attached to the first pouch along the intersection of the top side of the closed loop and the first lateral side, said web including an opening for receipt of a handle of a separate piece of luggage, said web extended a first defined width from the said intersection for fitting over said separate piece of luggage; and a second pouch flexibly attached to the web a distal space from the attachment of the web to the first pouch at least at said defined width, and said second pouch including a pouch side of said second pouch forming an extension of the web, said web and second pouch side defining a generally planar third lateral side attachable in face-to-face opposition with the first lateral side and alternatively foldable to position the second pouch spaced from the first pouch connected by the web.

2. The luggage of claim 1 further including straps for connecting the spaced pouches.

3. The luggage of claim 1 wherein the web includes a flap to close the opening.

4. The luggage of claim 1 wherein the first pouch includes at least one lateral flap connected to a side of the loop and foldable to at least partially enclose the first compartment.

5. The luggage of claim 1 wherein the first pouch includes first and second flaps attached respectively to opposite sides of said first pouch loop and foldable to at least partially enclose the first compartment.

6. The luggage of claim 4 or 5 wherein the flaps include means for retaining articles on said flaps.

7. The luggage of claim 1 wherein the first and third lateral sides are congruent.

8. The luggage of claim 1 including a fastener mechanism for attaching the first and third lateral sides.

9. The luggage of claim 1 including a third pouch attached to the second lateral side.

10. The luggage of claim 1 wherein the closed loop has a generally rectangular configuration.

11. Luggage having separable pouches connectable by a web comprising, in combination:

a first pouch including a closed loop lateral side with a top side and opposite first and second side panels attached to the closed loop to form the pouch and a handle attached to the pouch;

a second pouch including a third side panel opposed to the first side panel of the first pouch;

a web member connecting the first and third side panels in spaced relation, said web member including an opening for a handle of a separate piece of luggage; and a connecting fastener for attaching the first and third panels to close the opening and preclude placement of said handle from said separate piece of luggage.

12. The luggage of claim 11 wherein the web includes at least two sections connecting at least two separate sides of the panels.

13. The luggage of claim 11 wherein the third side panel of the second pouch is congruent with the first side panel of the first pouch.

14. The luggage of claim 11 wherein the second pouch is a mirror image of the first pouch.

15. The luggage of claim 11 wherein the second pouch includes a handle.

16. The luggage of claim 1 or 11 in combination with luggage including a generally planar side with a handle, said handle fitted through the opening.

17. The luggage of claim 11 wherein the luggage is comprised of a foldable, material and including an auxiliary bag attached to one of the pouches, for receipt of the folded material pouches and web.

18. The luggage of claim 11 wherein the connecting web comprises a flexible panel having first and second openings separated by a central rib whereby the connecting web may be folded with the openings overlying one another to provide a hand grip opening.

19. The luggage of claim 18 further including a stiffening member in the central rib extending generally parallel to the plane defined by the side panels to facilitate maintenance of the shape of the luggage.

20. The luggage of claim 11 further including auxiliary connectable straps for connecting the pouches.

21. The luggage of claim 11 wherein the handle extends upwardly from the top side of the pouch.

* * * * *